US011078056B2

(12) United States Patent
Vighi et al.

(10) Patent No.: US 11,078,056 B2
(45) Date of Patent: Aug. 3, 2021

(54) WINCH WITH SIMPLIFIED STRUCTURE

(71) Applicant: DANA BREVINI S.P.A., Reggio Emilia (IT)

(72) Inventors: Alessandro Vighi, Salsomaggiore Terme (IT); Stefano Lazzaretti, Poviglio (IT); Giovanni Mariech, Rovereto (IT)

(73) Assignee: Dana Motion Systems Italia S.r.l., Reggio Emilia (IT)

( * ) Notice: Subject to any disclaimer, the term of this patent is extended or adjusted under 35 U.S.C. 154(b) by 109 days.

(21) Appl. No.: 16/608,972

(22) PCT Filed: Apr. 24, 2018

(86) PCT No.: PCT/EP2018/060501

§ 371 (c)(1),
(2) Date: Oct. 28, 2019

(87) PCT Pub. No.: WO2018/197551

PCT Pub. Date: Nov. 1, 2018

(65) Prior Publication Data

US 2020/0189889 A1 Jun. 18, 2020

(30) Foreign Application Priority Data

Apr. 28, 2017 (IT) ..... 102017000046131

(51) Int. Cl.
*B66D 1/22* (2006.01)
*B66D 1/58* (2006.01)

(52) U.S. Cl.
CPC *B66D 1/22* (2013.01); *B66D 1/58* (2013.01)

(58) Field of Classification Search
CPC ... B66D 1/12; B66D 1/14; B66D 1/22; B66D 1/28; B66D 1/58; B66D 1/70; B66D 1/7484
See application file for complete search history.

(56) References Cited

U.S. PATENT DOCUMENTS 2,021,580 A * 11/1935 Osgood ..... B66D 1/08 254/361
2,350,120 A * 5/1944 Lawler ..... B66D 1/22 254/295

(Continued)

FOREIGN PATENT DOCUMENTS

CN 101134554 3/2008
EP 1897840 3/2008

(Continued)

OTHER PUBLICATIONS

European Patent Office, International Search Report with Written Opinion issued in PCT/EP2018/060501, dated Jul. 17, 2018, 12 pages, Rijswijk Netherlands.

*Primary Examiner* — Michael E Gallion

(74) *Attorney, Agent, or Firm* — Marshall & Melhorn, LLC

(57) ABSTRACT

A winch has a supporting frame with a first wall and a second wall. The winch also has a drum interposed between the first and second walls and is supported by them so as to rotate about its longitudinal axis which is transverse to the walls. The winch also has a flexible element for moving a load being wound around the drum. The winch also has a drive structure associated with the first wall and with a transmission structure for rotationally actuating the drum. The winch may also have a reaction element which is associated with the second wall, which supports the drum so as to rotate and which is associated with the transmission structure in order to support them.

10 Claims, 5 Drawing Sheets

(56) References Cited

U.S. PATENT DOCUMENTS 2,402,756 A * 6/1946 Lawler ..... F16H 1/28 254/344
2,418,267 A * 4/1947 Lawler ..... B66D 1/22 254/347
2,448,674 A * 9/1948 Lawler ..... B66D 1/16 254/305
2,552,859 A * 5/1951 Nardone ..... B66D 1/22 254/344
2,710,168 A * 6/1955 Robertson ..... B66D 1/14 254/357
3,319,492 A * 5/1967 Magnuson ..... B66D 5/12 475/12
3,477,316 A * 11/1969 Wildhaber ..... B66D 1/22 475/176
3,885,656 A * 5/1975 Michling ..... B66D 1/28 192/225
4,019,717 A * 4/1977 Freiburger ..... B66D 1/16 254/345
4,118,013 A * 10/1978 Christison ..... B66D 5/14 192/223.2
4,227,680 A * 10/1980 Hrescak ..... B66D 1/22 254/344
4,328,954 A * 5/1982 Logus ..... B66D 1/44 192/18 A
4,854,547 A * 8/1989 Oliphant ..... B66D 1/08 254/271
5,098,068 A * 3/1992 Jussila ..... B66D 1/28 254/342
5,255,895 A * 10/1993 Jussilla ..... B66D 1/22 254/344
7,614,609 B1 * 11/2009 Yang ..... B66D 1/22 254/344
7,658,370 B2 * 2/2010 Rotzler ..... B66D 3/18 254/344
8,517,348 B2 * 8/2013 Smith ..... B66D 3/18 254/385
9,637,360 B2 * 5/2017 Hall ..... B66D 1/46
9,988,248 B2 * 6/2018 Hall ..... B66D 5/32
2008/0061276 A1 * 3/2008 Averill ..... B66D 1/46 254/323
2010/0127228 A1 * 5/2010 Xie ..... B66D 5/14 254/346
2015/0083985 A1 * 3/2015 Lervik ..... B66D 1/12 254/340
2017/0362067 A1 * 12/2017 Hiekata ..... B66D 1/16

FOREIGN PATENT DOCUMENTS

JP S4842260 6/1973
JP S5762781 4/1982
JP S58162497 9/1983
JP S6229388 2/1987
JP H05155589 6/1993
JP 2005008321 1/2005

* cited by examiner

WINCH WITH SIMPLIFIED STRUCTURE

BACKGROUND

The present invention relates to a winch with simplified structure.

Winches are known which are substantially constituted by a frame that supports a drum that rotates about its own longitudinal axis and on which a flexible element for lifting is wound, and means for actuation in rotation of said drum, wherein, as a function of the direction of rotation of the drum, the flexible element is wound onto or unwound from the drum, lifting or lowering a load connected to its free end.

Such conventional winches can be provided with safety systems for detecting the load applied to the flexible element and reporting the exceeding of the maximum capacity for which the winch was dimensioned.

For example, EP 1,897,840 B1 discloses a winch in which the frame consists of a pair of walls provided with associated flanges that support the drum so that it can rotate by way of the interposition of respective bearings, of which a first wall also supports a motor associated with a planetary gear assembly for rotating the drum, and a second wall is provided with a seat, defined inside the corresponding flange, in which a pivot is accommodated for axial support and for coupling the planet gear carrier of the planetary gear assembly so as to rotate. Such pivot is removably inserted axially through the seat and is connected to the first wall so as not to rotate with respect thereto about its own longitudinal axis and so as to also, as a consequence, prevent the planet gear carrier connected thereto from rotating. The pivot can, therefore, be removed without compromising the correct positioning of the drum supported by the walls by way of the corresponding flanges.

Strain gauges are applied on the pivot for detecting deformations of the pivot proper; the signal read by such strain gauges is sent to an electronic unit that processes them to obtain the corresponding twisting moment applied to the pivot and determine, therefore, the load applied to the flexible element. Such electronic unit is generally connected to the PLC that runs the machine in which the winch is incorporated, so as to report hazardous situations or even interrupt its operation as a function of the load applied to the winch.

In more detail, the pivot is provided on its outer surface, in a central position with respect to its longitudinal extension, with an annular groove in which one or more pairs of strain gauges are accommodated and are connected by way of a cable to the control unit, which is arranged externally to the winch. For the passage of such connection cable, the pivot is provided with a hole that has a first portion with radial arrangement in communication with the annular groove and a second portion with axial arrangement facing toward the outside of the winch, which are mutually connected in order to connect the groove with the outside.

These conventional winches are not devoid of drawbacks among which is the fact that they require complex machining to be carried out, both to provide the corresponding components and to mount such components.

Execution of the first wall, in particular, requires very accurate and precise machining in consideration of the various surfaces for coupling that need to be provided inside the flange with the pivot and the corresponding sealing elements, and outside it with the bearing for supporting the drum.

Furthermore, in the assembly step, generally the first wall is placed on a work surface and the drum, pre-assembled with the corresponding sealing elements, has to be mounted on it, an operation that is quite complex given the weight and space occupation of the drum which has to be moved in order to position the sealing elements precisely.

Furthermore, positioning the sensors on the outer wall of the supporting pivot and the management unit outside it considerably complicates the provision of the pivot proper in terms of executing the annular groove and the passage hole of the connecting cable. Moreover the radial portion of the passage hole considerably weakens the supporting pivot, with the risk of compromising its functionality.

Last but not least, the external positioning of the control unit exposes it to the risk of being subjected to impact or damage, with the consequent need to replace it.

SUMMARY

The aim of the present invention is to eliminate the above mentioned drawbacks in the background art, by providing a winch with simplified structure that makes it possible to make both the step of providing the components, and the step of assembling them, simpler and more economical.

Within this aim, an object of the present invention is to enable an easy positioning of sensor elements for detecting the twisting moment generated by the load applied to the flexible element of the winch, without entailing complicated machining of the component parts.

Another object of the present invention is to make possible a protected accommodation of all the electronic components, in order to preserve their integrity and functionality.

Another object of the present invention is to provide a simple structure which is easy and practical to implement, safe in use and effective in operation, and low cost.

This aim and these and other objects which will become better apparent hereinafter are achieved by the present winch with simplified structure which comprises a supporting frame which comprises a first wall and a second wall which are mutually opposite, a drum which is interposed between said first and second walls and is supported by them so as to rotate about its longitudinal axis which is transverse to said walls, a flexible element for moving a load being wound around the drum, and drive means associated with said first wall and with transmission means for rotationally actuating said drum, which are accommodated inside said drum, characterized in that it comprises a reaction element which is associated with said second wall, which supports said drum so as to rotate by the interposition of at least one first bearing and which is associated with said transmission means in order to support them.

BRIEF DESCRIPTION OF THE DRAWINGS

Further characteristics and advantages of the present invention will become better apparent from the detailed description of some preferred, but not exclusive, embodiments of a winch with simplified structure, which are illustrated for the purposes of non-limiting example in the accompanying drawings wherein.

Figure 1:
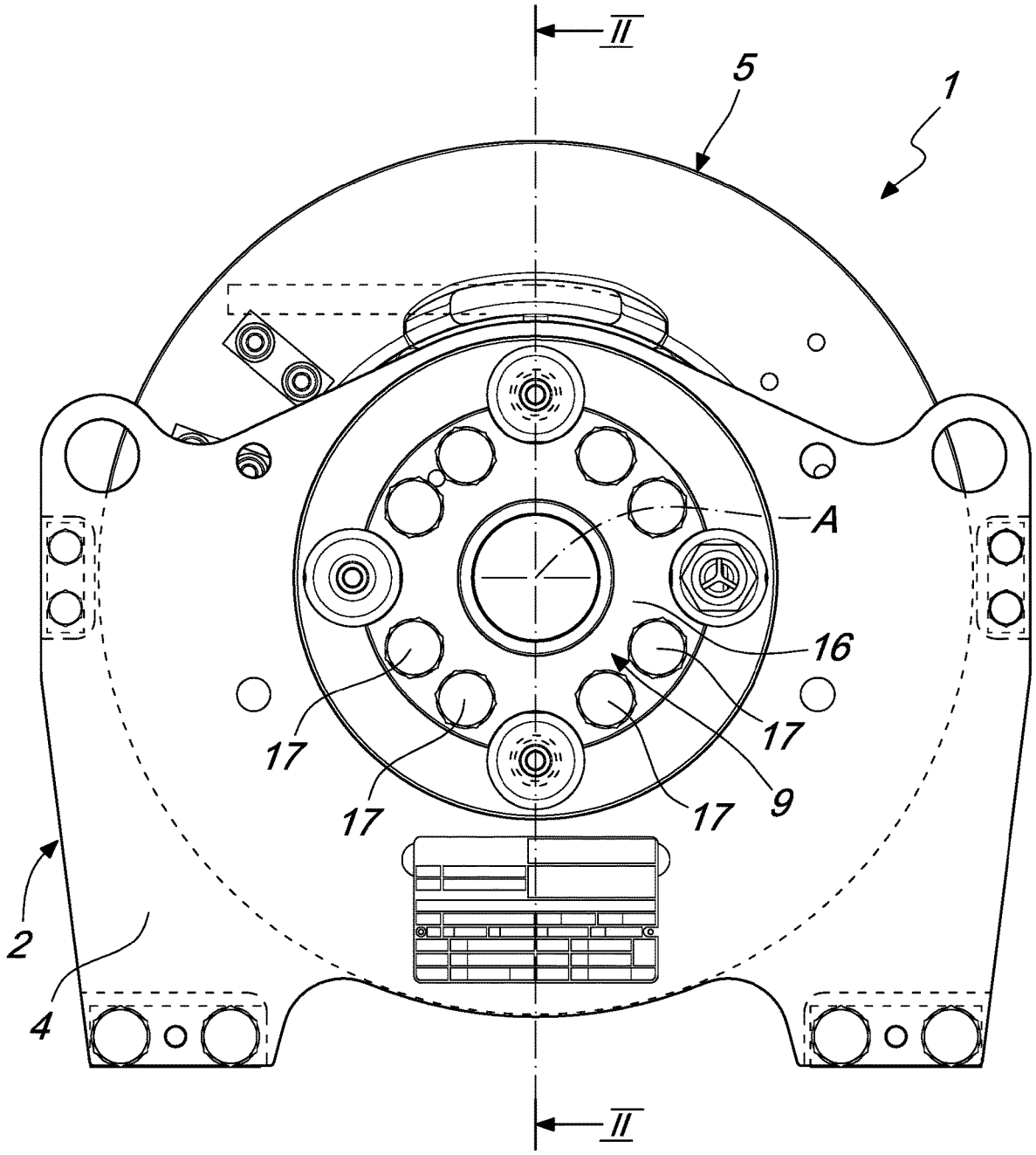
FIG. 1 is a side view of a first embodiment of a winch with simplified structure, according to the invention.
Figure 2:
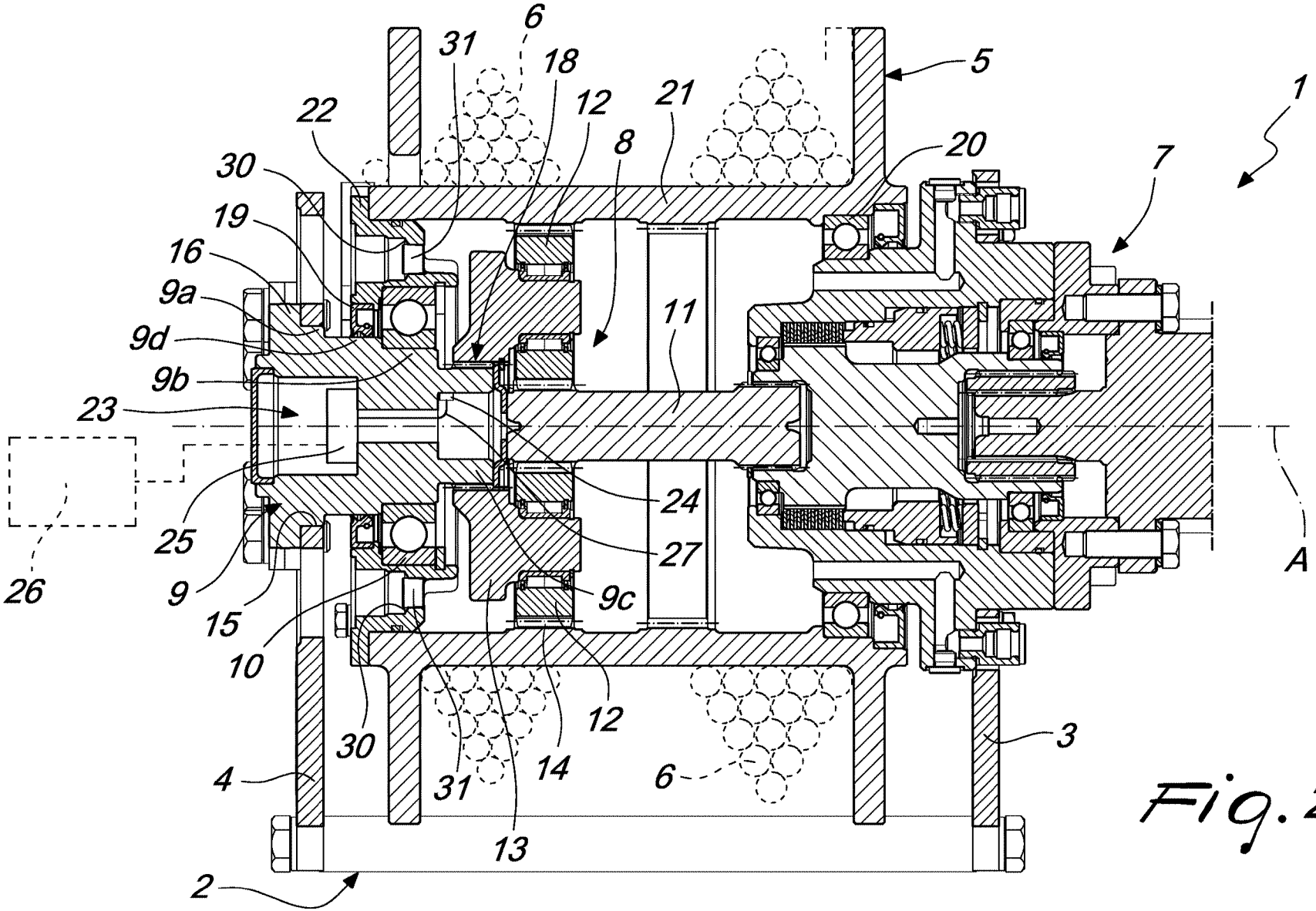
FIG. 2 is a cross-sectional view taken along the line II-II of the winch of FIG. 1.
Figure 3:
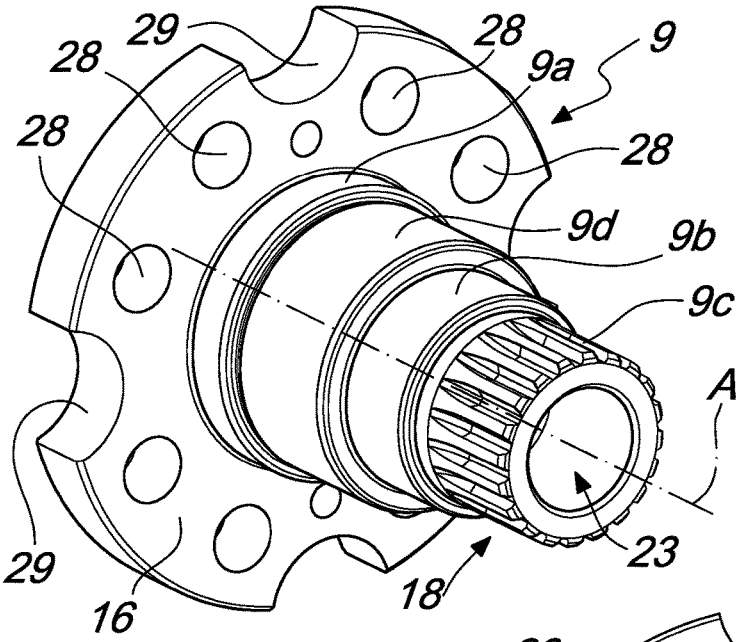
FIG. 3 is a perspective view of the reaction element of the winch of FIGS. 1 and 2.
Figure 4:
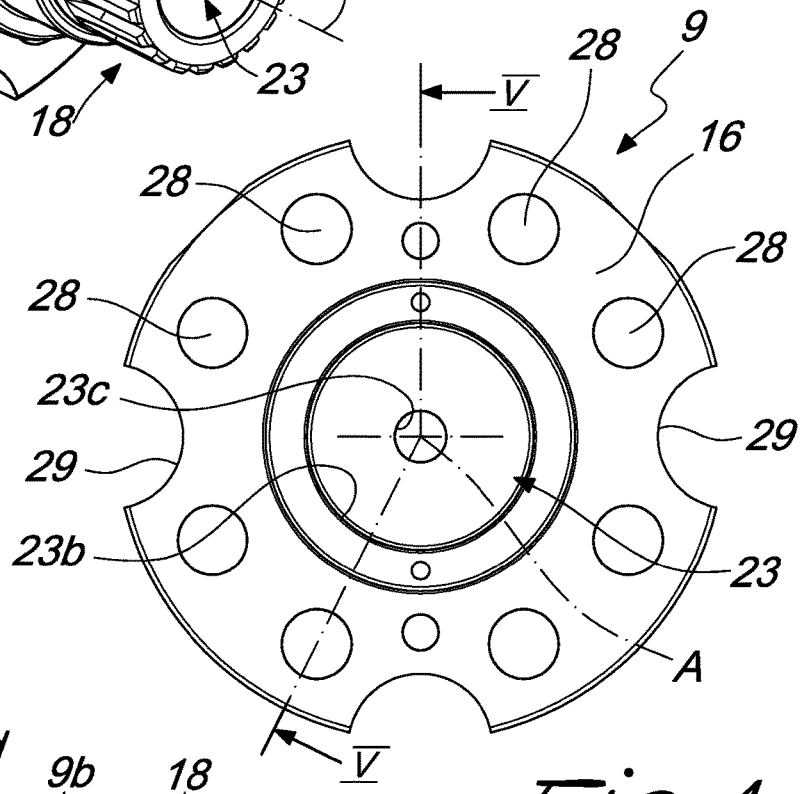
FIG. 4 is a side view of the reaction element of FIG. 3.
Figure 5:
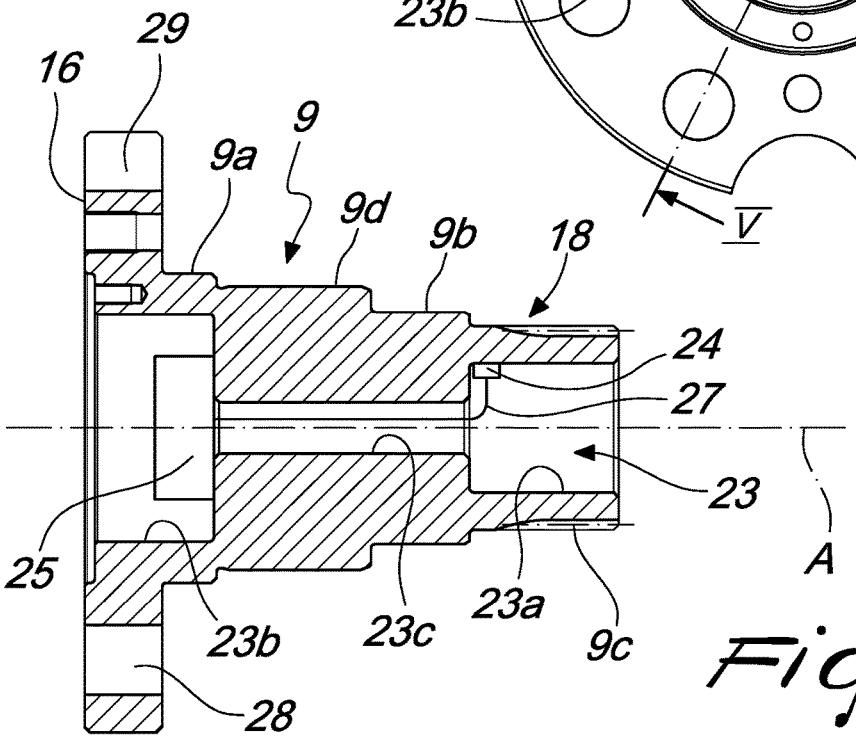
FIG. 5 is a cross-sectional view taken along the line V-V of the reaction element of FIG. 4.

With reference to the figures, the reference numeral 1 generally designates a winch with simplified structure.

DETAILED DESCRIPTION

The winch 1 comprises a supporting frame 2 which comprises a first wall 3 and a second wall 4 which are mutually opposite, and a drum 5 which is interposed between these walls and is supported so as to rotate about its longitudinal axis A which is transverse with respect to them. A flexible element 6, of the type of a cable or a chain, is wound around the drum 5 for moving a load hung on such element. The flexible element 6 has, in fact, an end that rotates integrally with the drum 5 and an opposite end that can be associated with the load to be raised/lowered as a function of the direction of rotation of the drum 5.

It should be noted that the winch 1 can be provided with its own frame 2 and be, therefore, designed to be installed as a free-standing assembly, or it can be incorporated into complex machinery that integrates the frame 2 with the associated walls 3 and 4, on which the other components are assembled.

The winch 1 further comprises drive means 7 which are supported by the first wall 3 and are associated with transmission means 8 for rotationally actuating the drum 5 about the axis A, which are accommodated inside the drum proper.

In fact, the term "drum" used here means a substantially cylindrical hollow body.

The winch 1 finally comprises a reaction element 9 which is connected to the second wall 4 at the axis A so as to prevent at least its rotation about such axis. The reaction element 9 performs a twofold structural function, since it supports the drum 5 so as to rotate by the interposition of at least one first bearing 10 and it is associated with the transmission means 8 in order to support them.

In more detail, the transmission means 8 comprise a planetary gear train with at least one reduction stage, which extends along the axis A and comprises a driving sun gear 11, which is associated with the drive means 7 and is engaged with at least two planet gears 12 which are supported so as to rotate about respective axes that are parallel to the axis A by a planet gear carrier 13 and in their turn are meshed with a ring gear 14 which is defined inside the drum 5. The reaction element 9 is connected to the planet gear carrier 13 so as to prevent it from rotating about the axis A; in this manner the rotation about the respective axes of the planet gears 12 coupled with the ring gear 14 actuates the rotation of the drum 5 about the axis A.

The drive means 7 can comprise a conventional motor with double direction of rotation, for example electric, hydraulic or pneumatic, the motorized output shaft of which is coupled to the sun gear 11, optionally by the interposition of intermediate connection elements.

The reaction element 9 consists of a pivot that extends along the axis A and has a variable cross-section, which has, along its extension, a first substantially cylindrical portion 9*a* which is inserted so that it passes through a corresponding hole 15 defined in the second wall 4, a second substantially cylindrical portion 9*b* for coupling with the first bearing 10, and a terminal shank 9*c* for coupling with the transmission means 8.

Furthermore the reaction pivot 9 has, at the end facing the outside of the drum 5, a flange 16 for connecting to the second wall 4, which protrudes radially outward from the first portion 9*a* and is connected to the second wall by way of a plurality of threaded elements 17 that are distributed in an annular fashion.

The terminal shank 9*c* has an external toothed profile which is adapted to mesh with a corresponding grooved profile provided on the planet gear carrier 13, resulting in a prismatic coupling 18 that rotationally couples the planet gear carrier to the reaction pivot 9, which in turn is prevented from rotating by the connection to the second wall 4, so as to prevent the rotation about the axis A of the planet gear carrier 13.

Furthermore, the reaction pivot 9 comprises a third substantially cylindrical portion 9*d* interposed between the first and the second portions 9*a* and 9*b*, for coupling with sealing elements 19 which are interposed between the drum 5 and the pivot proper.

The first portion 9*a*, the third portion 9*d*, the second portion 9*b* and the shank 9*c* have a cross-section that diminishes along the axial extension of the reaction pivot 9 in order to allow an easy mounting.

The drum 5 is supported radially so as to rotate also by the first wall 3. In the embodiment shown the drum 5 is supported by the first wall 3 by way of the drive means 7, which in turn are supported by said first wall, by the interposition of at least one second bearing 20. However, alternative embodiments are not ruled out of the rotating support of the drum 5 at the first wall 3.

The drum 5 comprises a substantially cylindrical side wall 21, which is integrally associated in rotation about the axis A with at least one support flange, which protrudes toward the inside of the side wall 21 at one of its axial ends and is supported so as to rotate by the reaction pivot 9 or by the drive means 7 by virtue of the interposition of the first or of the second bearing 10 or 20.

In the embodiments shown, the drum 5 has a support flange 22 which is associated with the end of the side wall 21 that is directed toward the second wall 4, which is connected to the side wall 21 by way of threaded elements, not shown in the figures. The possibility is not ruled out however that the side wall 21 and the support flange 22 can be made in a single piece. The flange 22 abuts against the reaction pivot 9 by virtue of the interposition of the first bearing 10, the sealing element 19 being interposed between the flange 22 and the reaction pivot 9 in order to prevent oil leaks.

Instead, at the end directed toward the first wall 3, the side wall 21 is supported radially so as to rotate by the drive means 7, by virtue of the interposition of the second bearing 20. The possibility is not ruled out that there could be an additional support flange connected to the side wall 21 at the first wall 3.

Conveniently the reaction pivot 9 internally comprises a through cavity 23 which extends along the axis A for accommodating means 24 for detecting the deformation of the pivot proper, which are functionally connected to an electronic processing unit 25 for determining the load applied to the flexible element 6 as a function of the detected deformation signal. The electronic unit 25, by way of algorithms known to the person skilled in the art, makes it possible to process the deformation data detected in order to obtain the twisting moment acting on the reaction pivot 9 from which, by way of an additional processing generally carried out by a controller PLC 26 in which other data are stored, the value of the load applied to the flexible element 6 is obtained.

The PLC 26, connected to the electronic board 25 by way of a corresponding cable, performs a control function and is adapted to report situations where the maximum load capacity of the winch 1 is exceeded, optionally interrupting its operation.

Advantageously, the detection means 24 are associated with the side wall of the cavity 23 at an axial position outside the prismatic coupling region 18 between the reaction pivot 9 and the planet gear carrier 13, so that the measurement of deformation detected is not influenced by the radial load acting on the pivot proper.

For example, the detection means 24 can be applied inside the cavity 23 by way of adhesive bonding carried out with conventional adhesive materials or by way of the PVD (Physical Vapor Deposition) process.

The cavity 23 has a first section 23*a* which faces the inside of the drum 5 and a second section 23*b* which faces outward, which are mutually connected by way of a connecting portion 23*c*. The detection means 24 are accommodated in the first section 23*a* and the electronic unit 25 is accommodated in the second section 23*b* with the corresponding connecting cable 27 passing through the connecting portion 23*c*.

The detection means 24 comprise at least one strain gauge and preferably at least four strain gauges arranged so as to constitute a conventional Wheatstone bridge.

In a first embodiment (FIGS. 1-5) the connecting portion 23*c* is arranged along the axis A. The connection flange 16 has eight holes 28 distributed in pairs, mutually angularly spaced apart by 90°, for the insertion of a corresponding number of threaded elements 17 for connecting to the second wall 4. The connection flange 16 is also provided with four perimetric slots 29, in pairs and angularly spaced apart by 90°, for the insertion of tubes, not shown, for carrying out filling/substitution of the hydraulic oil inside the drum 5 through respective openings 30, which in use are closed by corresponding plugs 31.

Figure 7:
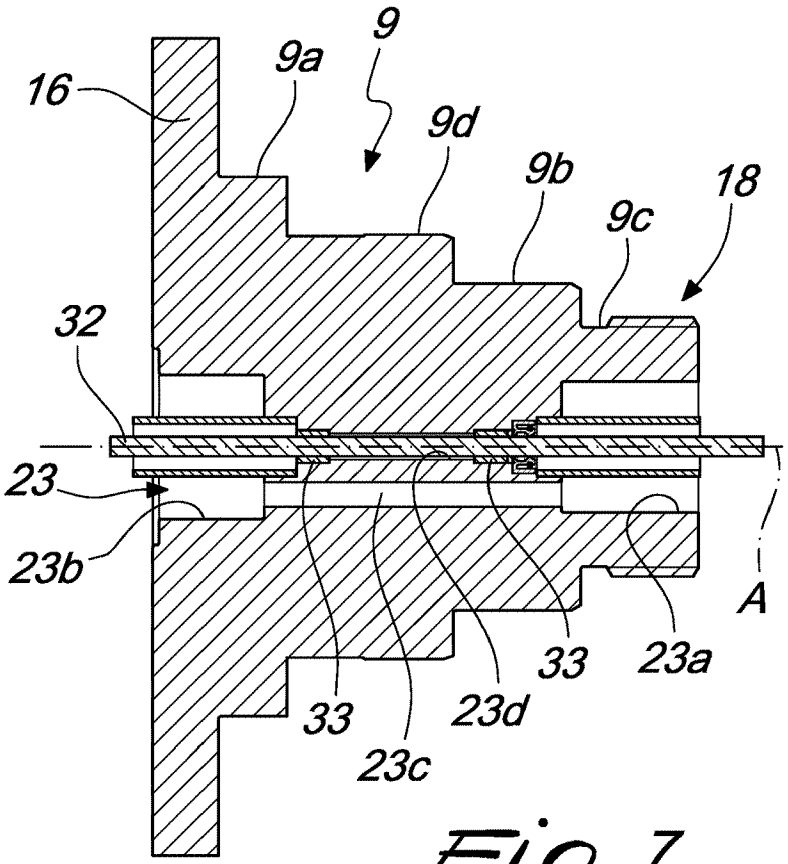
FIG. 7 is a cross-sectional view taken along the line VII-VII of the reaction element of FIG. 6.
Figure 6:
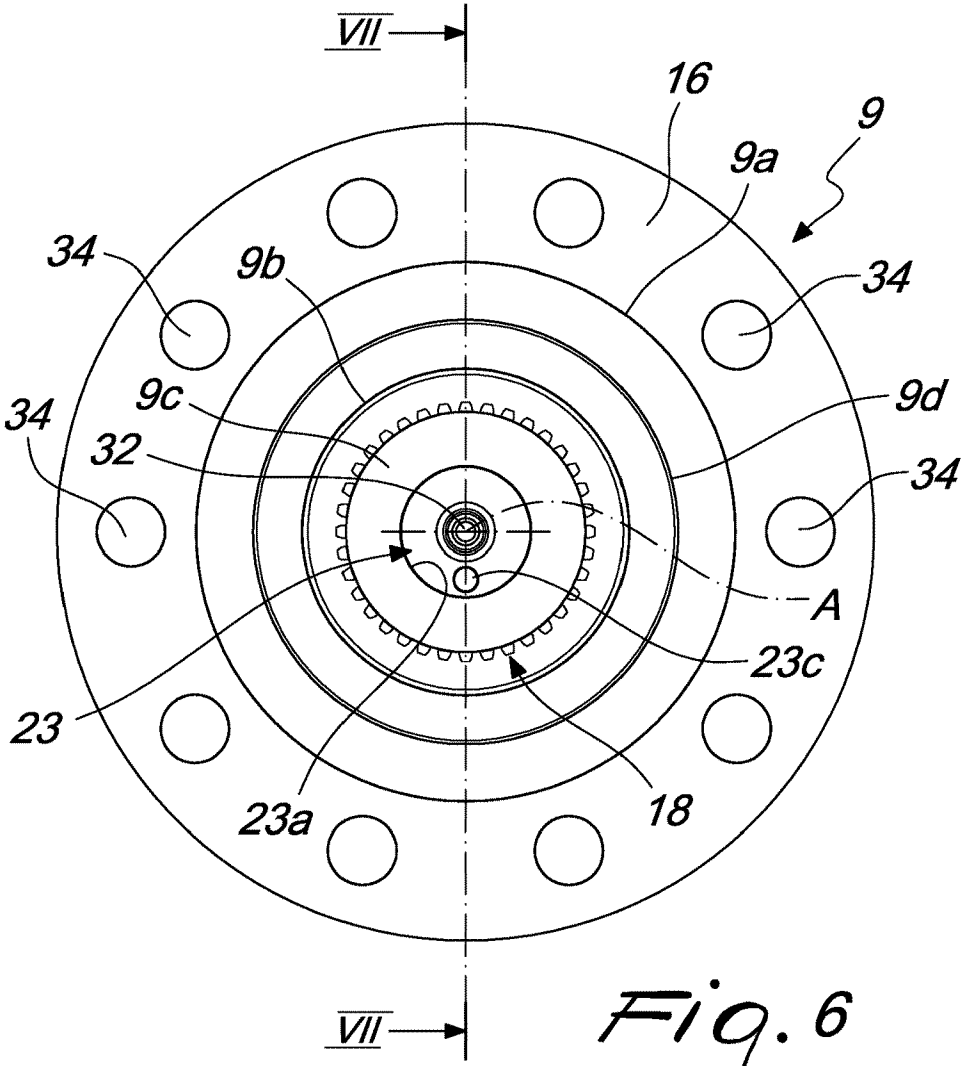
FIG. 6 is a side view of an alternative embodiment of the reaction element of the winch according to the invention.

FIGS. 6-7 show an alternative embodiment of the reaction pivot 9 in which the axial cavity 23 comprises a third section 23*d*, interposed between the first and the second sections 23*a* and 23*b* and coaxial to them, and the connecting portion 23*c* extends parallel to the axis A, but does not lie on it.

It should be noted that the transverse diameter of the first and of the second section 23*a* and 23*b* is greater than that of the third section 23*d*, so that the connecting portion 23*c* can extend parallel to the axis A, without having portions that extend radially with respect to the axis A.

In this manner, the cavity 23 can be used to accommodate a transmission shaft 32 which is coaxial to the axis A and supported so as to rotate about it by bushings or bearings 33 which are accommodated inside the cavity 23.

The transmission shaft 32 has a first end which protrudes inside the drum 5 and is associated so as to rotate integrally with the sun gear 11 and a second end, arranged opposite the first end and protruding outward, which is adapted to be connected to conventional means for detecting/limiting the number of revolutions and/or the rotation speed of the sun gear 11.

The connection flange 16 in this case has ten holes 34 for the insertion of threaded elements for connecting to the second wall 4.

Figure 8:
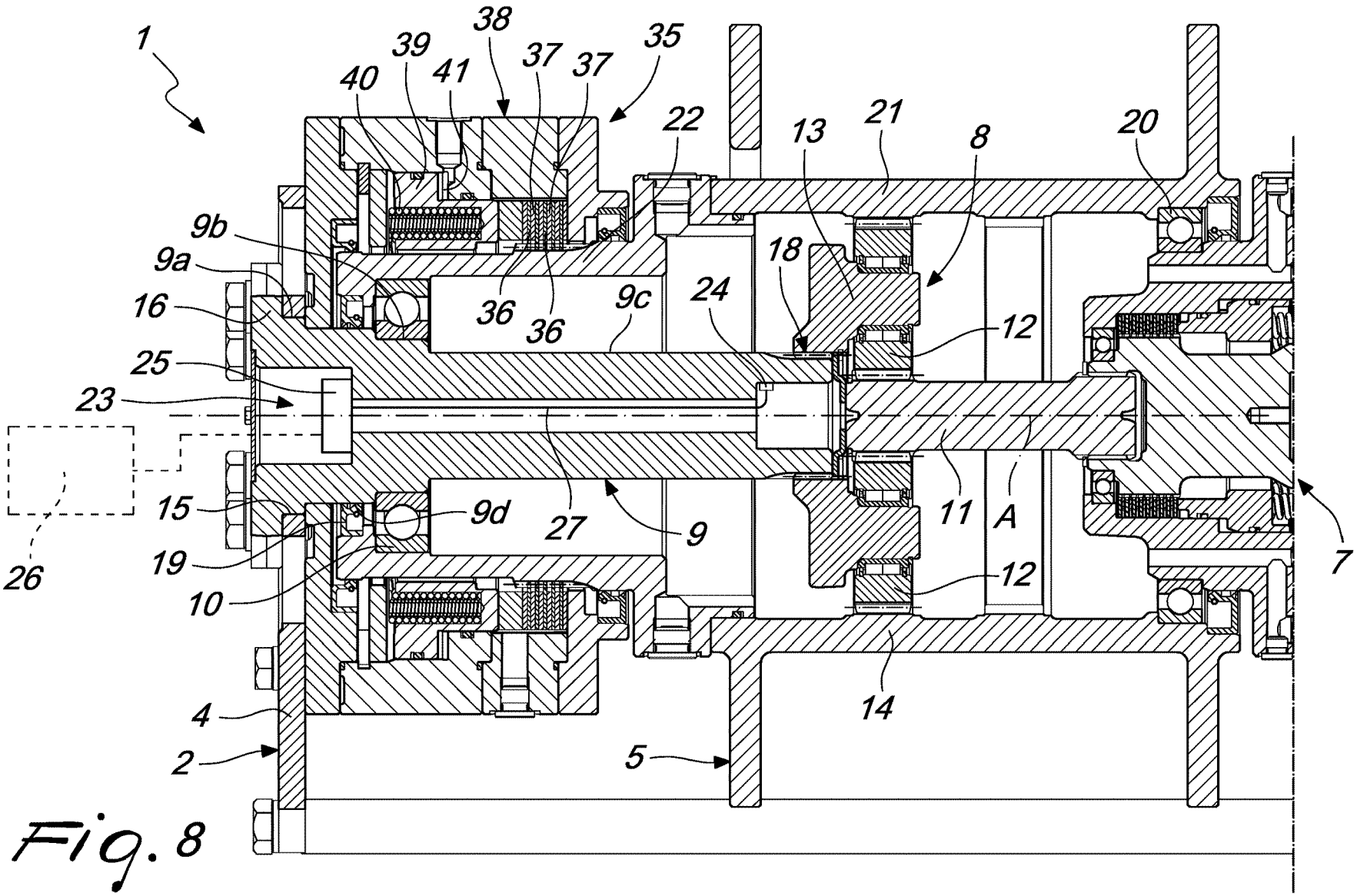
FIG. 8 is a longitudinal cross-sectional view of a second embodiment of the winch according to the invention.

FIG. 8 shows an alternative embodiment of the winch 1 in which the shank 9*c* of the reaction pivot 9 and the flange 22 have an axially elongated shape structure, so as to be able to provide a braking assembly 35 interposed between the drum 5 and the second wall 4 which makes it possible to independently brake the drum proper if the winch 1 is intended to lift persons and not just objects.

In this case the flange 22, in addition to supporting the side wall 21, acts as a braking shaft and carries a plurality of disks 36 interspersed by respective complementary disks 37 which are associated with an outer annular shell 38, which is rendered integral with the second wall 4 by through screws, not shown in the figure.

The disks 36 and the complementary disks 37 are associated, so that they can axially slide, respectively with the flange 22 and with the annular shell 38 by way of grooved couplings.

A pusher 39 is accommodated inside the annular shell 38 and is adapted to act on the pack of disks 36 and complementary disks 37 to brake the drum 5, on which an elastic compression spring 40 acts in the direction of moving toward the pack proper, and on which oil under pressure, fed by way of a conventional circuit, not shown, acts, in an annular chamber 41, in the direction of moving away.

Operation of the winch according to the present invention is the following.

In use the drive means 7, by way of the transmission means 8, actuate the drum 5 in rotation; as a function of the direction of rotation of the drum 5 the flexible element 6 is wound/unwound onto/from it, thus lifting/lowering the load connected to it.

During operation the detection means 24 applied to the reaction pivot 9 detect the deformations therein produced by the twisting moment acting thereon by virtue of the coupling with the planet gear carrier 13 and the deformation signal detected is processed by the electronic unit 25 and by the PLC 26 in order to determine the load hung from the flexible element 6, so as to monitor overload situations of the winch 1 thus preserving the safety of the machine.

It should be noted that, should it be necessary to dismantle the reaction pivot 9, it would be necessary to have a suitable support from outside the drum 5 to keep it in the correct position with respect to the axis A.

In practice it has been found that the invention as described achieves the intended aim and objects and, in particular, attention is drawn to the fact that the structure of the winch according to the invention does not require complex machining during production of the component elements or when mounting them. In particular the shape structure of the reaction element and of the associated coupling with the second wall, with the drum and with the planet gear carrier considerably simplifies the provision of the winch according to the invention.

Moreover, the possibility of having an axial accommodation of the detection means and of the electronic unit, both of which are integrated in the reaction pivot, makes it possible to perform an effective monitoring of the operating conditions of the winch, without complicating or weakening the structure of the pivot proper and adequately protecting the electronic components. Moreover, such solution makes it possible to also integrate an accessory transmission shaft in the reaction pivot, to be connected to the sun gear.

The invention, thus conceived, is susceptible of numerous modifications and variations, all of which are within the scope of the appended claims.

Moreover, all the details may be substituted by other, technically equivalent elements.

In practice the materials employed, as well as the contingent dimensions and shapes, may be any according to requirements without for this reason departing from the scope of protection claimed herein.

The disclosures in Italian Patent Application No. 102017000046131 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A winch with simplified structure comprising a supporting frame which comprises:

a first wall and a second wall which are mutually opposite, a drum which is interposed between said first and second walls and is supported by them so as to rotate about its longitudinal axis which is transverse to said walls, a flexible element for moving a load being wound around the drum, a drive structure associated with said first wall and with a transmission structure for rotationally actuating said drum, which are accommodated inside said drum, and a reaction element which is associated with said second wall, which supports said drum so as to rotate and which is associated with said transmission structure in order to support the transmission structure; wherein said reaction element internally comprises a cavity which extends along the rotation axis of said drum; the cavity having a detection structure that detects a torsional deformation of said element, which is functionally connected to an electronic processing unit for determining the load applied to said flexible element as a function of the detected deformation signal.

2. The winch according to claim 1, wherein said transmission structure comprises a planetary gear train which extends along the axis of rotation of said drum and is provided with a driving sun gear which is associated with said drive structure and is engaged with at least two planet gears which are supported so that they can rotate by a planet gear carrier and which are in turn engaged with a ring gear which is associated internally with said drum, the reaction element being associated with the planet gear carrier and with the second wall so as to prevent the rotation of said plant gear carrier.

3. A winch with simplified structure comprising a supporting frame which comprises: a first wall and a second wall which are mutually opposite, a drum which is interposed between said first and second walk and is supported by them so as to rotate about its longitudinal axis which is transverse to said walk, a flexible element for moving a load being wound around the drum, a drive structure associated with said first wall and with a transmission structure for rotationally actuating said drum, which are accommodated inside said drum, and a reaction element which is associated with said second which supports said drum so as to rotate and which is associated with said transmission structure in order to support the transmission structure; wherein said transmission structure comprises a planetary gear train which extends along the axis of rotation of said drum and is provided with a driving sun gear which is associated with said drive structure and is engaged with at least two planet gears which are supported so that they can rotate by a planet gear carrier and which are in turn engaged with a ring gear which is associated internally with said drum, the reaction element being associated with the planet gear carrier and with the second wall so as to prevent the rotation of said plant gear carrier; wherein said reaction element comprises a pivot with a cross-section, which extends along the axis of rotation of said drum which has a first substantially cylindrical portion which is inserted into a corresponding hole defined in said second wall, a second substantially cylindrical portion which is associated with said drum by interposition of at least one first bearing and a terminal shank for coupling with said transmission structure; wherein a detection structure comprises a connection cable that passes through the terminal shank and the second cylindrical portion.

4. The winch according to claim 3, wherein said pivot comprises a third substantially cylindrical portion, which is interposed between the first portion and the second portion, for coupling with at least one sealing element which is interposed between said pivot and said drum.

5. The winch according to claim 1, wherein said drum is supported so as to rotate by said first wall by way of said drive structure by interposition of at least one second bearing.

6. The winch according to claim 1, wherein said drum comprises a substantially cylindrical side wall which is associated integrally, so as to rotate about the rotation axis, with at least one support flange which is supported so as to rotate by said reaction element.

7. The winch according to claim 6, further comprising a braking assembly, which is interposed between said reaction element and said support flange.

8. The winch according to claim 1, wherein said detection structure is associated with the inner side wall of said cavity in an axial position external to the coupling region between said reaction element and said transmission structure.

9. The winch according to claim 8, wherein said cavity comprises a first section, which faces the inside of said drum, and a second section, which faces outward, said sections being mutually connected by way of a connecting portion, the detection structure being accommodated in the first section and the electronic unit being accommodated in the second section with the corresponding connecting cable passing through the connecting portion.

10. The winch according to claim 1, further comprising a transmission shaft, which is supported so as to rotate about the rotation axis of said drum inside said cavity, the transmission shaft having a first end which is associated so as to rotate integrally with said sun gear and a second end which is opposite the first one and can be associated with a device for detecting/limiting the number of turns and/or the rotation rate of said sun gear.

* * * * *